US009334725B2

(12) United States Patent
Sitka

(10) Patent No.: US 9,334,725 B2
(45) Date of Patent: May 10, 2016

(54) BOREHOLE FLUID-PULSE TELEMETRY APPARATUS AND METHOD

(71) Applicant: Halliburton Energy Services, Inc., Houston, TX (US)

(72) Inventor: Mark Anthony Sitka, Richmond, TX (US)

(73) Assignee: Halliburton Energy Services, Inc, Houston, TX (US)

( * ) Notice: Subject to any disclaimer, the term of this patent is extended or adjusted under 35 U.S.C. 154(b) by 0 days.

(21) Appl. No.: 14/439,455

(22) PCT Filed: Dec. 30, 2013

(86) PCT No.: PCT/US2013/078275
§ 371 (c)(1),
(2) Date: Apr. 29, 2015

(87) PCT Pub. No.: WO2015/102571
PCT Pub. Date: Jul. 9, 2015

(65) Prior Publication Data
US 2016/0040529 A1 Feb. 11, 2016

(51) Int. Cl.
*E21B 47/18* (2012.01)

(52) U.S. Cl.
CPC ..... *E21B 47/18* (2013.01)

(58) Field of Classification Search
CPC ..... E21B 47/16; E21B 47/18; E21B 47/187; E21B 34/16; E21B 34/10; E21B 34/06
See application file for complete search history.

(56) References Cited

U.S. PATENT DOCUMENTS 3,867,714 A 2/1975 Patton
4,785,300 A 11/1988 Chin (Continued)

OTHER PUBLICATIONS

"International Application Serial No. PCT/US2013/078275, International Search Report mailed Sep. 29, 2014", 4 pgs.

(Continued)

*Primary Examiner* — Hai Phan
*Assistant Examiner* — Sisay Yacob
(74) *Attorney, Agent, or Firm* — Schwegman Lundberg & Woessner, P.A.; Alan Bryson

(57) ABSTRACT

A fluid pulse generator for use in a drill string comprises an elongate obstruction member mounted in a fluid passage for driven pivoting about a pivot axis transverse to the fluid passage, obstruction of the fluid passage by the obstruction member being variable in relation to pivotal position of the obstruction member. Telemetry signals can be transmitted along the drill string by driven pivoting of the obstruction member, to generate data pulses in drilling fluid in the drill string. Pressure-locking of the obstruction member in a maximally obstructive position can be counteracted by provision of a bypass arrangement to allow bypass flow at a leading end of the obstruction member.

20 Claims, 10 Drawing Sheets

(56) References Cited

U.S. PATENT DOCUMENTS

| | | | | |
|---|---|---|---|---|
| 5,586,083 | A | 12/1996 | Chin et al. | |
| 5,586,084 | A | 12/1996 | Barron et al. | |
| 5,740,126 | A | 4/1998 | Chin et al. | |
| 5,787,052 | A | 7/1998 | Gardner | |
| 6,219,301 | B1 | 4/2001 | Moriaty | |
| 6,915,845 | B2 * | 7/2005 | Leising | E21B 23/01 166/117.6 |
| 7,230,880 | B2 | 6/2007 | Lehr | |
| 7,327,634 | B2 | 2/2008 | Perry et al. | |
| 7,382,686 | B2 | 6/2008 | Innes | |
| 2003/0056985 | A1 | 3/2003 | Hahn et al. | |
| 2003/0221830 | A1 * | 12/2003 | Leising | E21B 23/01 166/278 |
| 2005/0034454 | A1 * | 2/2005 | Innes | E21B 47/187 60/533 |
| 2005/0260089 | A1 | 11/2005 | Hahn et al. | |

OTHER PUBLICATIONS

"International Application Serial No. PCT/US2013/078275, Written Opinion mailed Sep. 29, 2014", 4 pgs.

* cited by examiner

BOREHOLE FLUID-PULSE TELEMETRY APPARATUS AND METHOD

PRIORITY APPLICATIONS

This application is a U.S. National Stage Filing under 35 U.S.C. 371 from International Application No. PCT/US2013/078275, filed on 30 Dec. 2013, which application is incorporated herein by reference in its entirety.

TECHNICAL FIELD

This application relates generally to methods and apparatus for borehole fluid telemetry; and more particularly relates to generating fluid pulse telemetry signals.

BACKGROUND

Borehole fluid telemetry systems, often referred to as mud pulse systems, use borehole fluid, such as so-called drilling mud, as a medium to transmit information from the bottom of a borehole to the surface. Such information is useful during operations for the exploration and/or discovery of hydrocarbons such as oil and gas. Virtually any type of data that may be collected downhole can be communicated to the surface using borehole fluid telemetry systems, including information about the drilling operation or conditions, as well as logging data relating to the formations surrounding the well. Information about the drilling operation thus transmitted may include, for example, pressure, temperature, direction and/or deviation of the wellbore, as well as drill bit condition. Formation data may include, by way of an incomplete list of examples, sonic density, porosity, induction, and pressure gradients of the formation. The transmission of this information is important for control and monitoring of drilling operations, as well as for diagnostic purposes.

Borehole fluid telemetry systems produce fluid pulse telemetry signals comprising transient borehole fluid pressures variations. The fluid pulse telemetry signals often comprise data pulses produced by a valve arrangement (e.g. a rotary shear valve or a poppet valve). The rate of data pulse production, and therefore of transmission bandwidth, may be limited by the mechanics of the particular apparatus used in generating fluid pulses downhole.

BRIEF DESCRIPTION OF THE DRAWINGS

Some embodiments are illustrated by way of example and not limitation in the figures of the accompanying drawings in which:

FIG. 2D depicts an axial section of a fluid pulse transmitter unit in which an elongate obstruction member is mounted on an off-center pivot axis, thereby to cause the provision of a bypass clearance in the fluid passage at a leading end of the obstruction member in a maximally obstructive position, according to an example embodiment.

DETAILED DESCRIPTION

Figure 1:
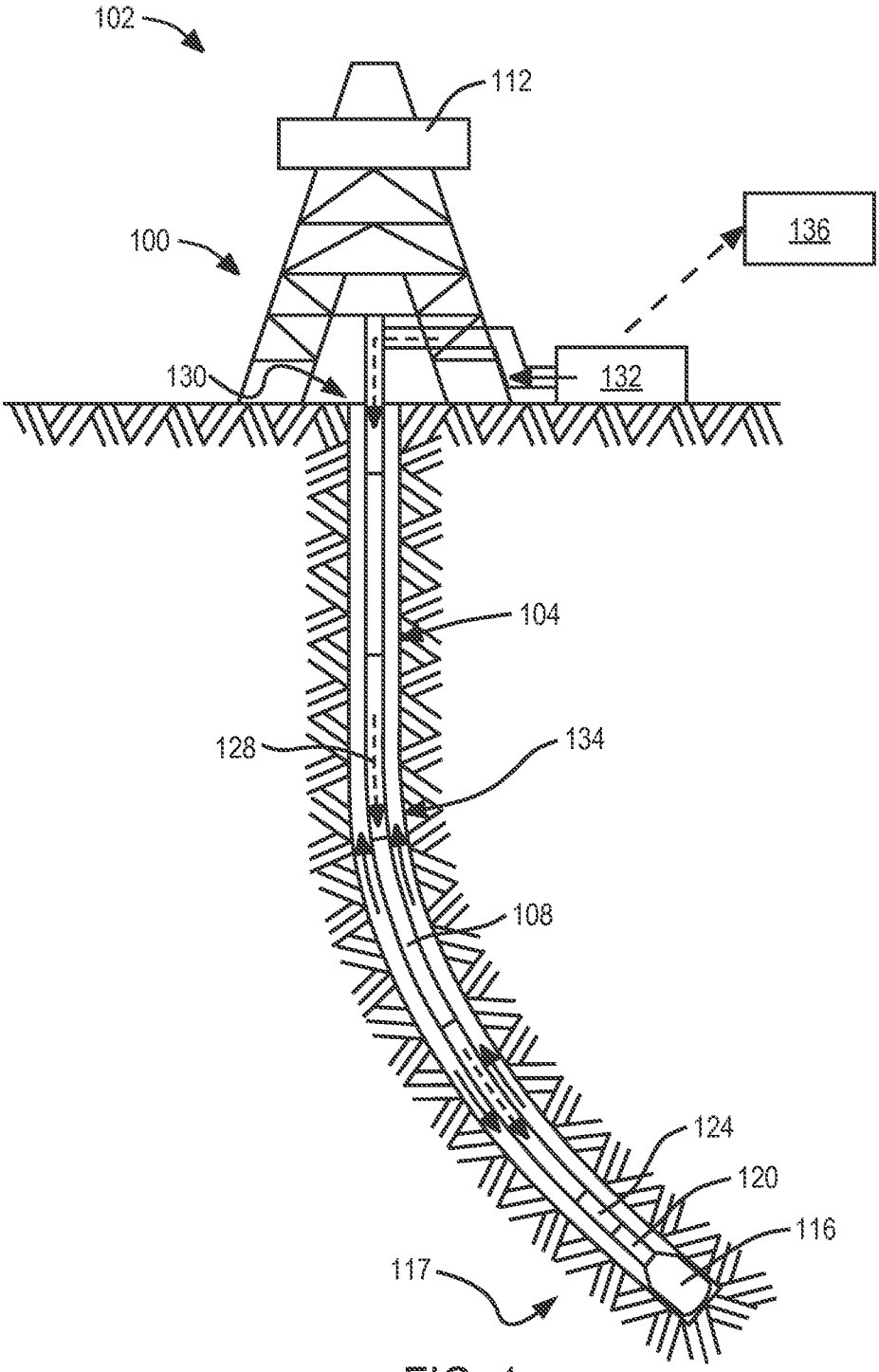
FIG. 1 depicts a schematic diagram of a drilling installation that includes a drill string including a telemetry assembly to generate fluid pulse telemetry signals in borehole fluid, in accordance with an example embodiment.

The following detailed description refers to the accompanying drawings that depict various details of examples selected to show how the disclosed subject matter may be practiced. The discussion addresses various examples of the disclosed subject matter at least partially in reference to these drawings, and describes the depicted embodiments in sufficient detail to enable those skilled in the art to practice the disclosed subject matter. Many other embodiments may be utilized for practicing the disclosed subject matter other than the illustrative examples discussed herein, and structural and operational changes in addition to the alternatives specifically discussed herein may be made without departing from the scope of the disclosed subject matter.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

One aspect of the disclosure provides a fluid pulse generator comprising an elongate obstruction member that is mounted in a fluid passage for driven pivoting about a pivot axis transverse to flow of borehole fluid through the passage. An extent to which flow through the fluid passage is obstructed varies in relation to pivotal position of the obstruction member. Data pulses can be generated in the borehole fluid by driven pivoting of the obstruction member.

The fluid passage may have a complementary noncircular (e.g., oblong) cross-section, with the obstruction member extending generally lengthwise along the passage. The obstruction member may be configured for bidirectional pivoting about the pivot axis. The pivot axis may be transverse to an axis of the fluid passage. The pivot axis of the obstruction member may extend in a direction generally perpendicular to the fluid passage, for example. In some embodiments, the pivot axis is oriented transversely, for example perpendicularly, to a tool axis which, in operation, may extend substantially co-axially along the drill string.

The obstruction member may be controllably pivoted about the pivot axis to vary an obstruction of flow through the fluid passage, to generate fluid-pulse telemetry signals in the borehole fluid in a drill string in which the fluid pulse generator is mounted. "Reciprocation" in this context may be used to refer to a controlled pivoting of the obstruction member in alternating directions about the pivot axis. The obstruction member and the fluid passage may be shaped and dimensioned such that a range of pivoting motion of the obstruction member is limited by contact between the obstruction member and walls of the fluid passage. The range of pivoting motion of the obstruction member about the pivot axis may thus be limited to an acute angle. The maximum angular pivoting of the obstruction member about the pivot axis may in some embodiments be between 30° and 60°.

FIG. 1 is a schematic view of an example embodiment of a system 100 to provide fluid pulse telemetry signals in a borehole fluid. A drilling installation 102 includes a subterranean borehole 104 in which a drill string 108 is located. The drill string 108 comprises segments of drill pipe connected end-to-end and suspended from a drilling platform 112 secured at a wellhead 130. A downhole assembly or bottom hole assembly (BHA) at a bottom end of the drill string 108 includes a drill bit 116. The BHA 117 also includes a measurement and control assembly 120 which comprises measurement instruments to measure borehole parameters, drilling performance, and the like. The drill string 108 includes an example embodiment of a fluid pulse telemetry assembly, in this example comprising a telemetry tool 124 that is connected in-line in the drill string 108 to produce data pulses in borehole fluid conveyed by the drill string 108. The telemetry tool 124 comprises an actuated obstructer arrangement to selectively produce fluid pulse telemetry signals comprising data pulses in the borehole fluid, as described in greater detail below.

The borehole 104 is thus an elongate cavity that is substantially cylindrical, having a substantially circular cross-sectional outline that remains more or less constant along the length of the borehole 104. The borehole 104 may in some cases be rectilinear, but may often include one or more curves, bends, doglegs, or angles along its length. As used with reference to the borehole 104 and components therein, the "axis" of the borehole 104 (and therefore of the drill string 108 or part thereof) means the longitudinally extending centerline of the cylindrical borehole 104 (corresponding, for example, to longitudinal axis 217 in FIG. 2A).

In the context of the drill string 108 and the borehole 104, (a) "axial" or "longitudinal" means a direction along a line substantially parallel with the lengthwise direction of the borehole 104 at the relevant point or portion under discussion; (b) "radial" means a direction substantially along a line that intersects the borehole axis and lies in a plane transverse to the borehole axis, so that at least a directional component is perpendicular to the borehole axis; (c) "tangential" means a direction substantially along a line that does not intersect the borehole axis and that lies in a plane transverse to the borehole axis, so that at least a directional component lies in a plane perpendicular to the borehole axis; and (d) "circumferential" refers to a substantially arcuate or circular path described by rotation of a tangential vector about the borehole axis. "Pivotal" movement, as well as its derivatives, may be used to refer to angular displacement about a particular axis.

As used herein, movement or location "forwards" or "downhole" (or related terms) means axial movement or relative axial location along the length of the borehole 104 towards the drill bit 116, away from the surface. Conversely, "backwards," "rearwards," or "uphole" means movement or relative location axially along the borehole 104, away from the drill bit 116 and towards the Earth's surface. Note that in FIGS. 2A-2D and 5 of the drawings, the downhole direction of the drill string 108 extends from left to right across the page. Further, as used herein, the adjectives "trailing" and "leading" refer to location relative to fluid flow within the drill string 108 (which is typically in the downhole direction). Therefore, unless indicated otherwise, a "leading" element of a particular component is typically located at or adjacent an uphole end of the component, while a "trailing" element is typically located at or adjacent a downhole end of the component.

Borehole fluid may include drilling mud circulated from a borehole fluid reservoir 132 at the Earth's surface. The fluid reservoir 132 is fluidly coupled to the wellhead 130 by means of a pump system (not shown) that forces the borehole fluid down a borehole fluid conduit 128 provided by a hollow interior of the drill string 108, so that the borehole fluid exits under high pressure through the drill bit 116. The borehole fluid exiting from the drill bit 116 flows up through a borehole annulus 134 defined between the drill string 108 and a wall of the borehole 104. The borehole fluid carries cuttings generated by the drill bit up from the bottom of the borehole 104 to the wellhead 130. The cuttings are removed from the borehole fluid, typically by filtering, and the borehole fluid may be returned to the borehole fluid reservoir 132. A measurement and control system 136 at the surface is in communication with the BHA 117 via the borehole fluid, e.g. by means of a fluid pressure sensor or sensors at or adjacent to the wellhead 130, to receive and/or decode data pulse telemetry signals generated by the telemetry tool 124.

Figure 2A:
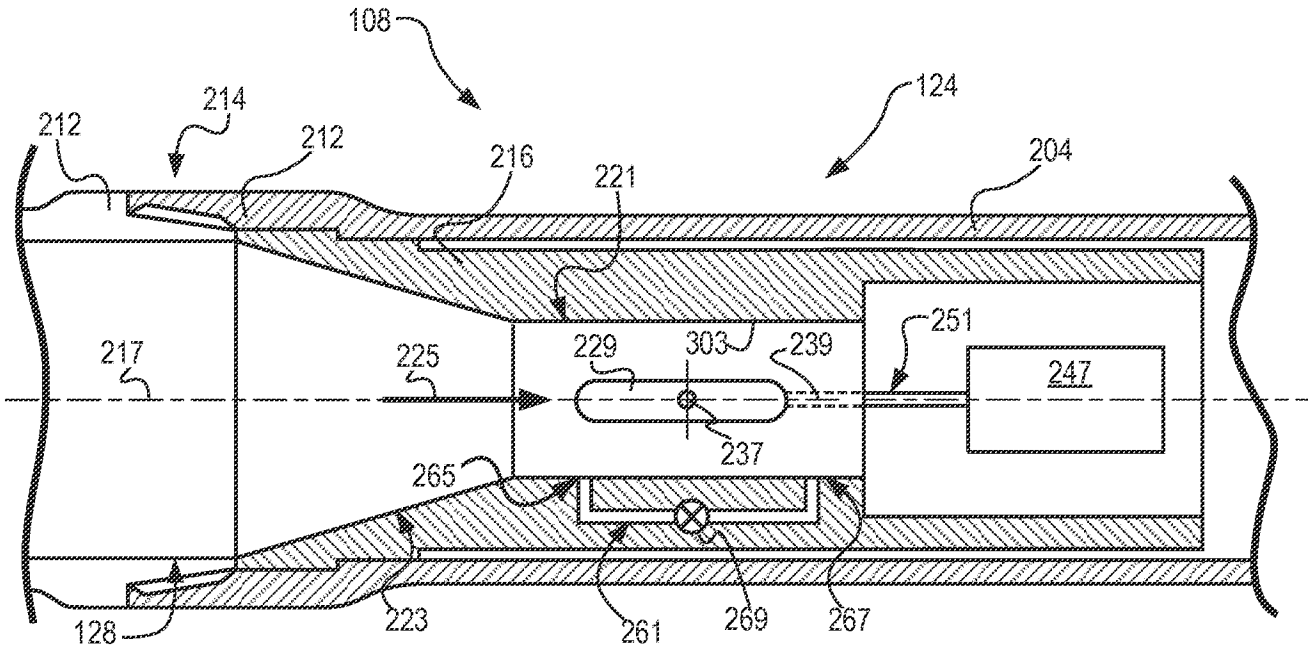
FIGS. 2A-2D depict an axial section of part of a telemetry assembly forming part of a bottom hole assembly in a drill string, in accordance with an example embodiment, a pivotally movable obstruction member (e.g. a "transmitter bar" or "transmitter pin") of the telemetry assembly being shown in a minimally obstructive position in FIG. 2A, and being shown in oppositely disposed maximally obstructive positions in FIG. 2B and FIG. 2C respectively.

FIG. 2A shows a more detailed view of an example embodiment of a telemetry assembly provided by the telemetry tool 124. The telemetry tool 124 includes an elongate, generally tubular housing 204 that is connected in-line in the drill string 108, so that a hollow interior of the housing 204 forms a portion of the fluid conduit 128 of the drill string 108. The housing 204 is connected to adjacent drill pipe segments 212 of the drill string 108 at its opposite ends. In the example embodiment of FIG. 2A, the housing 204 is shown as being connected to an adjacent drill pipe segment 212 by a threaded box joint coupling 214.

The housing 204 includes a sleeve body 216 that is received coaxially in the housing 204 at its uphole end. The sleeve body 216 defines a signal generator passage (alternately referred to simply as a "passage") 221 in the fluid conduit 128. The passage 221 extends longitudinally along the drill string 108, to convey drilling mud through the passage 221 in a fluid flow direction 225 that is axially aligned with a longitudinal axis 217 of the housing 204. The passage 221 has a constricted cross-sectional area relative to the fluid conduit 128, with the sleeve body 216 defining a funnel formation 223 at its uphole end (i.e., at an inlet of the signal generator passage 221), to channel fluid flow along the fluid conduit 128 into the passage 221.

An elongate, rigid obstruction member is pivotably mounted in the signal generator passage 221, to generate data pulse telemetry signals in the borehole fluid by controllably varying an extent to which the passage 221 is obstructed. In this example embodiment, the obstruction member comprises an elongate transmitter bar 229 that is pivotably mounted in the signal generator passage 221 and is angularly displaceable relative to the passage 221 to pivot about a pivot axis 237 that extends transversely to the passage 221. The pivot axis 237 in this example embodiment is perpendicular to the fluid flow direction 225. The pivot axis 237 intersects the passage 221, substantially bisecting a depth dimension (d) of the passage 221 (see, e.g., FIG. 3).

A lengthwise axis or polar axis 239 of the transmitter bar 229 is oriented transversely to the pivot axis 237, in this example embodiment being perpendicular to the pivot axis 237. The polar axis 239 of the transmitter bar 229 therefore extends generally along the length of the passage 221 (also referred to as the axis of the passage 221), with an incidence angle of drilling mud flowing in the fluid flow direction 225 relative to the lengthwise direction of the transmitter bar (i.e., relative to its polar axis 239) varying in response to pivoting of the transmitter bar axis about the pivot axis 237. The example transmitter bar 229 is elongate, having a substantially circular cylindrical body portion, with hemispheroidal ends 233.

Figure 3:
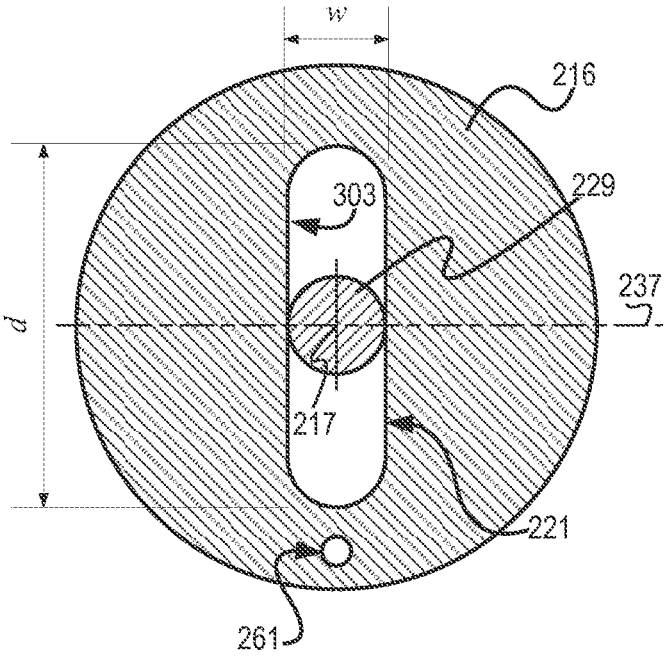
FIG. 3 depicts a cross-sectional end view of a part of the telemetry assembly of FIG. 2A, according to an example embodiment.

Turning briefly to FIG. 3, which shows a part of the sleeve body 216 in cross-sectional end view, it will be seen that the example signal generator passage 221 has a non-circular cross-sectional outline, being elongate such that the above-mentioned depth dimension, d (perpendicular to the pivot axis 237), is greater than an orthogonal width dimension, w, substantially parallel to the pivot axis 237. In this example, the signal generator passage 221 has a peripheral wall 303 that is oblong in cross-sectional outline, having substantially rectilinear opposed side walls parallel to the depth dimension, and having concavely curved (e.g. semicircular) end portions complementary to the convex ends of the transmitter bar 229. Note that, in this example, the cross-sectional outline of the passage 221 corresponds substantially to an axial projection of the outline of the transmitter bar 229 when pivoted through its full range of motion, as will be described below.

Figure 2B:
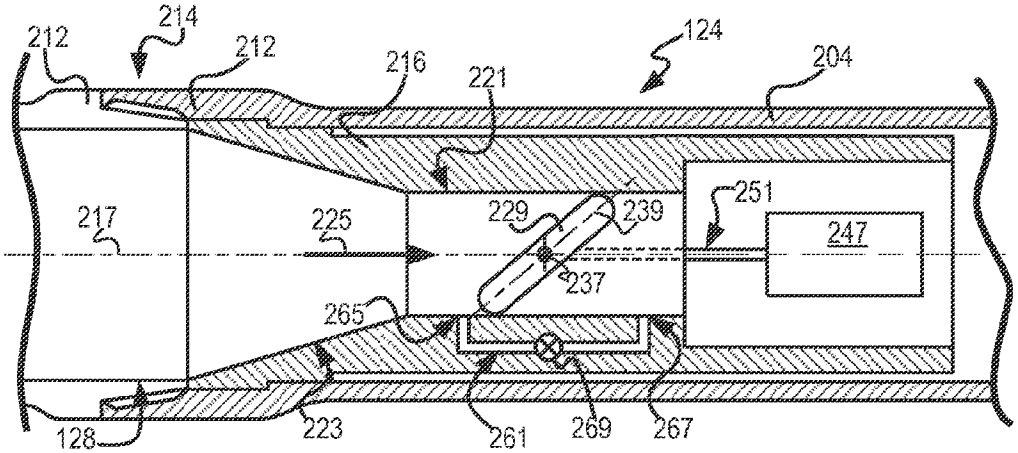
Figure 2C:
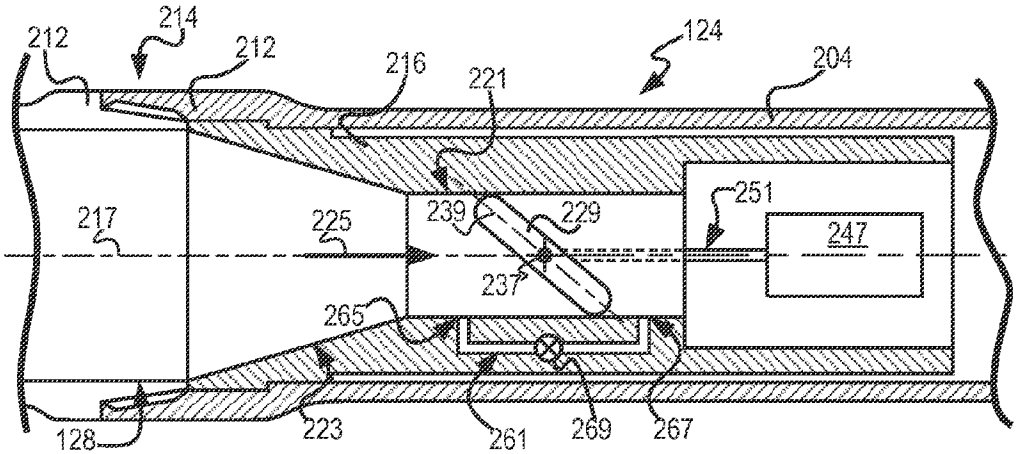

As will be seen when considering FIGS. 3 and 2B together, the transmitter bar 229 in this example embodiment is configured substantially to occlude the passage 221, blocking fluid flow through the passage 221, when it is in a maximally obstructive position (FIGS. 2B and 2C). Referring again to FIG. 3, note that a width of the transmitter bar 229 is selected in this example such that transmitter bar 229 substantially spans the passage 221 widthwise, being a sliding fit in the passage 221. In this example, the transmitter bar 229 is a free running fit or a loose running fit in the passage 221.

The transmitter bar 229 is in a minimally obstructive position (also referred to herein as the rest position) when the transmitter bar 229 is longitudinally aligned with the fluid flow direction 225 (see FIG. 2A and also FIG. 3). In contrast, the transmitter bar 229 is in a maximally obstructive position (FIGS. 2B and 2C) when it is disposed at a maximum angle allowed by the passage 221. More particularly, the extent of pivotal displacement of the transmitter bar 229 is in this example limited by its geometry relative to that of the passage 221. As can best be seen from FIGS. 2B and 2C, a length of the transmitter bar 229 is greater than the depth (d) of the passage 221, in this example embodiment being configured to have a maximum angular displacement of about 30° in either direction relative to the minimally obstructive position of FIG. 2A, so that the range of motion of the transmitter bar 229 about the pivot axis 237 is about 60°.

In other embodiments, a limiting mechanism may be provided to stop pivoting of the transmitter bar 229 short of an angle at which its ends make contact with the passage wall 303, so that the ends of the transmitter bar 229 are clear of the passage wall 303, even in the maximally obstructive position. In such cases, at least some fluid flow through may therefore be permitted between end gaps defined between the respective ends of the transmitter bar 229 and the passage wall 303, even when the transmitter bar 229 is in the maximally obstructive position. As will be described with reference to the example embodiment of FIG. 2D, a gap or clearance may in some embodiments be defined between at least one of the ends of the transmitter bar 229 and the passage wall 303, when the transmitter bar 229 is in the maximally obstructive position.

In the minimally obstructive position (FIG. 2A), the polar axis 239 of the transmitter bar 229 is substantially parallel to the fluid flow direction 225. At positions between the minimally obstructive position (FIG. 2A) and the maximally obstructive positions (FIG. 2B and FIG. 2C), the flow of drilling mud through the passage 221 is limited to flow through the pair of end gaps defined between the opposite ends of the transmitter bar 229 and corresponding end portions of the passage wall 303. It will be appreciated that resistance to fluid flow through the passage 221 generally increases with a decrease in size of the end gaps, with the end gaps being at a maximum when the transmitter bar 229 is in the minimally obstructive position.

The telemetry tool 124 further includes a drive mechanism in the example form of a motor 247 coupled to the transmitter bar 229 by a linkage 251, to transmit torque and angular displacement to the transmitter bar 229, thereby to cause reciprocating pivotal movement of the transmitter bar 229 in opposite pivot directions. Although the motor 247 and the linkage 251 are shown only schematically in FIG. 1, a more detailed description of the example embodiment of the linkage 251 follows below with reference to FIGS. 5 and 6. In operation, amplitude and/or frequency of reciprocating movement of the transmitter bar 229 may be controlled by control of the motor 247, to vary characteristics of fluid pulses or fluid pressure variations in the borehole fluid uphole of the transmitter bar 229, and thus to produce data-carrying fluid pulse signals propagating uphole from the telemetry tool 124.

The telemetry tool 124 may further include a bias arrangement to bias the transmitter bar 229 to the minimally obstructive position (FIG. 2A), e.g., by exerting a biasing torque on the transmitter bar 229 in response to movement of the transmitter bar 229 away from the minimally obstructive position. Operation of the bias arrangement thus results in automatic movement of the transmitter bar 229 towards (and retention thereof in) the minimally obstructive position, absent application of any external torque thereto by the drive mechanism. In this example embodiment, the bias arrangement is incorporated in the drive mechanism, so that the transmitter bar 229 is urged to the minimally obstructive rest position (FIG. 2A) by its coupling to the drive mechanism, both when the transmitter bar 229 is inactive with respect to data pulse transmission and during oscillating movement excited or driven by the drive mechanism. In other example embodiments, the bias arrangement may comprise an elastically resilient bias member, e.g., a torsion spring coupled to the transmitter bar 229 to exert a resistive torque thereon responsive to pivoting of the transmitter bar 229 away from the rest position.

Figure 2D:
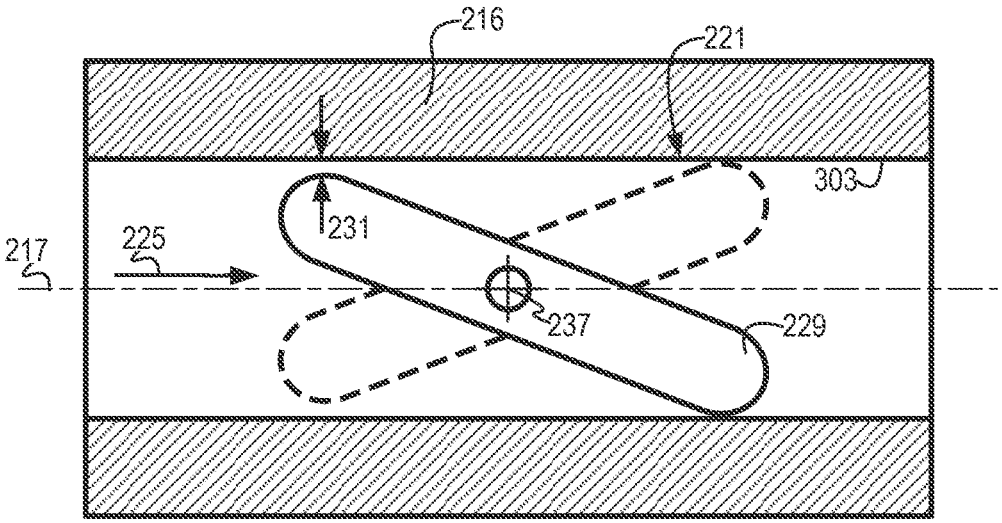

In other embodiments, one example of which is schematically illustrated in FIG. 2D, the bias arrangement may be configured to cause biasing of the transmitter bar 229 to its rest position (i.e., to the minimally obstructive position) by hydrodynamic action of borehole fluid flowing through the passage 221. Such hydrodynamic biasing may comprise, for example, mounting the transmitter bar 229 off-center on the pivot axis 237, so that a trailing leg of the transmitter bar 229 (i.e., that portion extending from the pivot axis 237 to the trailing end of the transmitter bar 229) is somewhat longer than a leading leg of the transmitter bar 229 (i.e., that portion extending between the pivot axis 237 and the leading end of the transmitter bar 229). When the transmitter bar 229 is at an angle relative to the fluid flow direction 225, hydrodynamic forces on the leading leg will tend to exert a closing torque on the transmitter bar 229 (i.e., urging the transmitter bar 229 further away from the minimally obstructive position and towards the closest maximally obstructive position). Conversely, hydrodynamic forces acting on the trailing leg will tend to exert an opening torque on the transmitter bar 229 (i.e., urging the transmitter bar 229 further away from the closest maximally obstructive position and towards the minimally obstructive position). In embodiments where the trailing leg is longer (e.g., FIG. 2D), a net torque exerted on the transmitter bar 229 by the flow of borehole fluid through the signal generator passage 221 will thus be an opening torque that urges the transmitter bar 229 towards the minimally obstructive position.

In other embodiments, the transmitter bar 229 may, conversely, be configured to use hydrodynamic forces acting thereon for assistance in displacing the transmitter bar 229 from the longitudinal, rest position, so that a resultant torque on the transmitter bar 229 due to hydrodynamic action of the borehole fluid is a closing torque (consistent with the terminology of the above description). In such cases, the transmitter bar 229 may be mounted off-center on the pivot axis 237, so that the leading leg is longer than the trailing leg. Note that different hydrodynamic behavior at the leading end and at the trailing end of the transmitter bar 229, respectively, due to the angle of incidence of the fluid flow on the transmitter bar 229, may cause a resultant torque to be exerted on the transmitter bar 229 by the borehole fluid, even in embodiments (such as the example embodiments of FIG. 2A-2D) where the transmitter bar 229 is centered on a pivot axis 237 that is, in turn, centered in the passage 221. Localized areas of low pressure downstream of the transmitter bar 229 resulting from hydrodynamic drag may sometimes be asymmetrical, thus causing a net torque to be exerted on the transmitter bar 229.

In this embodiment, the ends of the transmitter bar 229 are semi-spherical, but note that differently shaped profiles for the leading and trailing ends of the transmitter bar 229 can be utilized to influence pulse amplitude and torque. The telemetry tool 124 may be configured to produce data pulses by controlled pivoting of the transmitter bar 229 about the pivot axis 237, with the minimally obstructive position (FIG. 2A) serving as a null position for the oscillatory movement, the reciprocating pivotal movement being substantially symmetrical about the null position. In operation, oscillation of the transmitter bar 229 at a particular frequency will result in a series of fluid pulses of corresponding frequency, facilitating fluid pulse data encoding and transmission.

The telemetric signals represented by the fluid pressure pulses can be modulated in one or more known modulation schemes. In one embodiment, frequency shift key modulation (FSK), or variations thereof, may be used, comprising driving bidirectional pivoting of the transmitter bar 229 at controlled, varying frequencies. Instead, amplitude shift key modulation (ASK), or variations thereof, may be used, comprising driving bi-directional pivoting of the transmitter bar 229 to different displacement angles from its minimally obstructive position, to generated pulses of varying amplitude. Phase Shift Keying (PSK) and Pulse Position (PPM) modulations, and variations thereof, may also be used. In some embodiments, a combination of ASK, FSK, PSK, and PPM modulation may be employed.

In some embodiments, oscillation of the transmitter bar 229 may be damped, so that an amplitude of the pivotal oscillation describes a progressively decreasing sinusoidal curve after initial excitation. The damping of the transmitter bar's (229) movement may be by operation of the bias arrangement described previously. In this example embodiment, in which the bias arrangement is incorporated in the drive mechanism, damped oscillation of the transmitter bar 229 may be caused substantially directly by alternating torque applied to the transmitter bar 229 by the drive mechanism. In other embodiments, for example embodiments in which a bias arrangement separate from the drive mechanism dynamically resists movement of the transmitter bar 229, action of the drive mechanism on the transmitter bar 229 may comprise the application of an initiating torque or moment on the transmitter bar 229, to impart an initial angular displacement to the transmitter bar 229 from the minimally obstructive position, thus exciting or inducing oscillatory movement facilitated by dynamically resistive action of the relevant bias arrangement.

It will be appreciated that, when the transmitter bar 229 is in its maximally obstructive position, fluid flow through the passage 221 is restricted, in this example embodiment (in which the passage 221 is occluded by the transmitter bar 229) being substantially completely blocked or occluded. Because borehole fluid on an upstream side of the transmitter bar 229 is pressurized (e.g., by a pumping system of the drilling installation 100), while borehole fluid on the downstream side of the transmitter bar 229 may be in substantial fluid flow isolation from the upstream side due to occlusion of the passage 221 by the transmitter bar 229, pivotal displacement of the transmitter bar 229 away from the maximally obstructive position may be strongly resisted by hydraulic action of the borehole fluid. In some instances hydraulic resistance to movement away top dead center or bottom dead center may be large enough to prevent the transmitter bar 229 from pivoting away from the maximally obstructive position. This phenomenon is referred to herein as pressure-locking.

One of the mechanisms that contribute to pressure-locking is that expansion of an included volume between the passage wall 303 and the transmitter bar 229 at its leading end is needed for the transmitter bar 229 initially to pivot open. Such initial expansion tends, however, to cause a drop of fluid pressure on the downstream side of the transmitter bar 229 at its leading end, exacerbating a pressure differential across the transmitter bar 229 at that end and causing a closing torque to be exerted on the transmitter bar 229. The telemetry tool 124 may be provided with an anti-locking mechanism for preventing or counteracting pressure-locking of the transmitter bar 229 in the maximally obstructive position. In some embodiments, the anti-locking mechanism may comprise a bypass arrangement configured to permit or facilitate relief flow from an upstream side of the transmitter bar 229 to the downstream side thereof, when the transmitter bar 229 is in the maximally obstructive position.

The example embodiment of FIG. 2A includes a bypass arrangement that comprises a pressure relief passage 261 defined by the sleeve body 216 and circumventing the transmitter bar 229. The example pressure relief passage 261 has an inlet port 265 in the signal generator passage 221 upstream of the leading end of the transmitter bar 229 (i.e., uphole thereof). The pressure relief passage 261 provides a fluid flow channel between the inlet port 265 and an outlet port 267 downstream of the transmitter bar 229. The pressure relief passage 261 thus permits relief flow of borehole fluid from the upstream side to the downstream side of the transmitter bar 229, preventing or releasing any pressure-lock by reducing a pressure difference in the signal generator passage 221 between the locations of the inlet port 265 and the outlet port 267 respectively.

Figure 4:
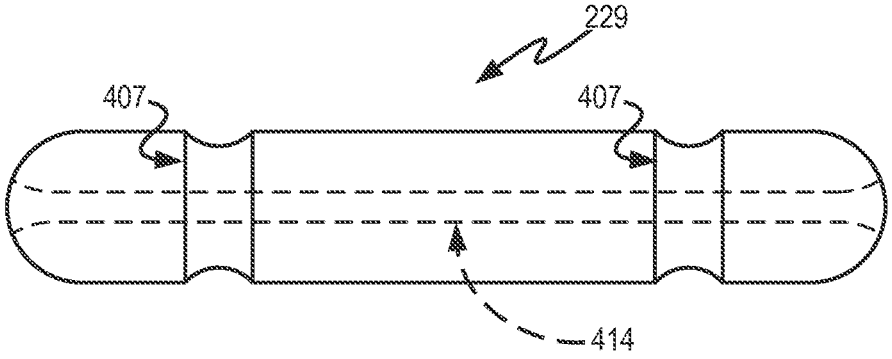
FIG. 4 depicts an isolated side view of an obstruction member for forming part of a fluid pulse telemetry assembly, in accordance with another example embodiment.

The bypass arrangement further comprises, in this example embodiment, a valve mechanism in the example form of a check valve 269 in the pressure relief passage 261, to permit flow through the relief passage 261 only when the differential pressure across it exceeds a predetermined threshold value. Fluid flow through the pressure relief passage 261 is thus substantially prevented by the check valve 269 during normal operation, with the check valve 269 being configured automatically to open when pressure-lock conditions exist. Instead, or in addition, the transmitter bar 229 may be shaped and configured to provide bypass channels between an exterior surface of the transmitter bar 229 and the passage wall 303. FIG. 4 shows an example embodiment of a transmitter bar 229 providing such exterior bypass channels. The transmitter bar 229 of FIG. 4 has a pair of peripheral grooves in its exterior surface, in this example comprising at pair of circumferentially extending annular grooves 407 on the cylindrical portion of the transmitter bar 229, adjacent its respective ends 233.

The example transmitter bar 229 additionally has an internal bypass channel 414 extending co-axially along the polar axis 239 of the transmitter bar 229, and opening out of both ends of the transmitter bar 229. In operation, borehole fluid can flow through the internal bypass channel 414 and/or through channels defined between the annular grooves 407 and the respective sides of the passage wall 303 that flank the transmitter bar 229. Note that, while the example transmitter bar 229 has both the internal bypass channel 414 and the annular grooves 407, other embodiments may have only an internal bypass channel or may have only a peripheral bypass channel.

Instead, or in combination, the bypass arrangement may inherently be provided by the respective geometries and the spatial arrangement of the transmitter bar 229 and the fluid passage 221. FIG. 2D provides an example embodiment of such a structurally inherent anti-locking bypass arrangement, in which the transmitter bar 229 is mounted off-center on the pivot axis 237. In this example, the pivot axis 237 is closer to the leading end of the transmitter bar 229 than to its trailing end, while the pivot axis 237 is located centrally in the fluid passage 221, bisecting the fluid passage 221 perpendicularly. As a result, a gap or clearance 231 between the transmitter bar 229 and the passage wall 303 is defined at the leading end of the transmitter bar 229 even when the transmitter bar 229 is in the maximally obstructive position. As can be seen in FIG. 2D the maximally obstructive positions for the off-center transmitter bar 229 is achieved when its trailing end is pivoted in either pivot direction into contact with the passage wall 303, at which point of the leading end is short of the passage wall 303, leaving the clearance 231. Drilling fluid that in operation flows through the clearance 231 counteracts pressure-locking of the transmitter bar 229 in the maximally obstructive position.

Note that similar anti-locking bypass flow effects can in other embodiments be achieved by other suitable mechanisms to provide that a transmitter bar such as that discussed above abuts against a corresponding passage wall at only one of its ends, when in a maximally obstructive position. In one example, a passage similar to that described with reference to FIG. 2D can have a non-rectilinear profile when viewed in axial section (responding to the view of FIG. 2), with the passage being shaped such that a transmitter bar centered on a centrally located pivot axis 237 can in each maximally obstructive position bear against a passage wall at only one of its opposite ends.

It is a benefit of the example telemetry tool 124 as described that it is radially relatively compact, when compared, e.g., to rotary data pulse telemetry systems. Despite having a relatively low radial profile, the inventors have found that the amplitude of data pulses generated by the transmitter bar 229 surprisingly compares favorably to the amplitude of data pulses generated by typical rotary data pulsers. A further benefit is that a torque load on the motor 247 is reduced relative to that of prior systems. This is due, in part, to hydrodynamic behavior of the transmitter bar 229 in the borehole fluid flow, as described previously. Momentum of borehole fluid flowing along the fluid conduit 128 may, in other words, be used to assist at least some parts of the movement of the transmitter bar 229 during signal generation. Another benefit of the disclosed pulse generating technique is that the obstruction member (e.g., the transmitter bar 229) is automatically biased to its minimally obstructive position, so that it is not necessary explicitly to actuate the obstruction member to a particular orientation in order to clear the fluid conduit 128 when the telemetry tool 124 is dormant.

Figure 5:
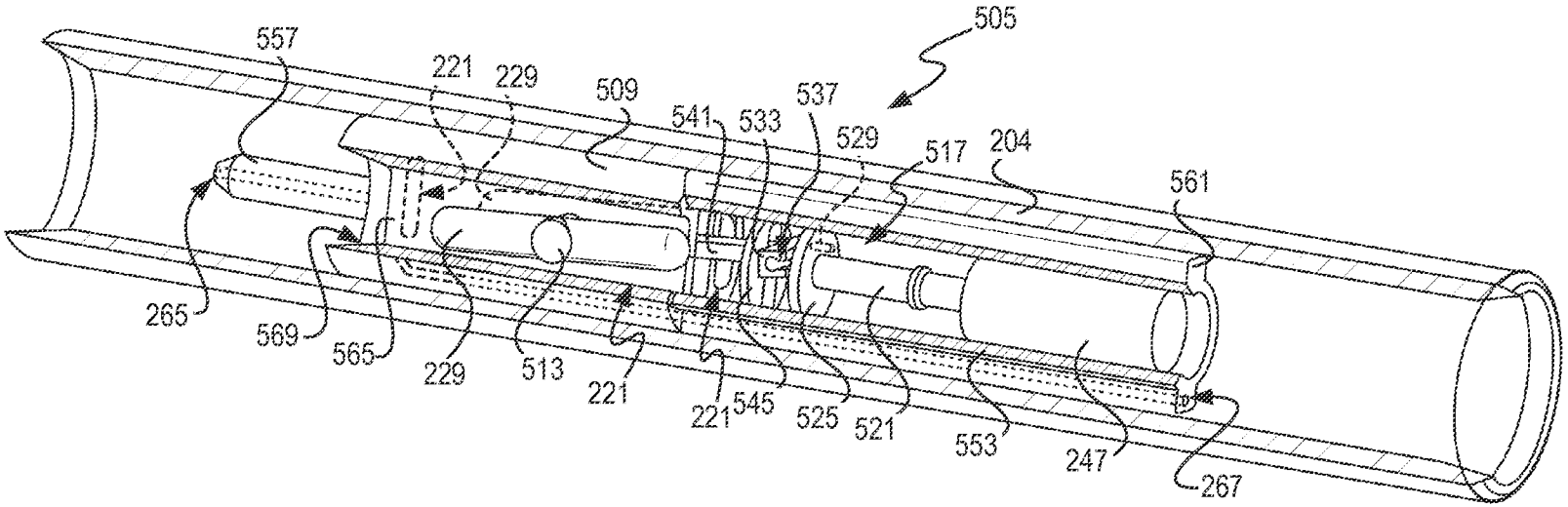
FIG. 5 depicts a partially sectioned three-dimensional view of a drill string portion that includes a telemetry assembly in accordance with a further example embodiment.
Figure 6:
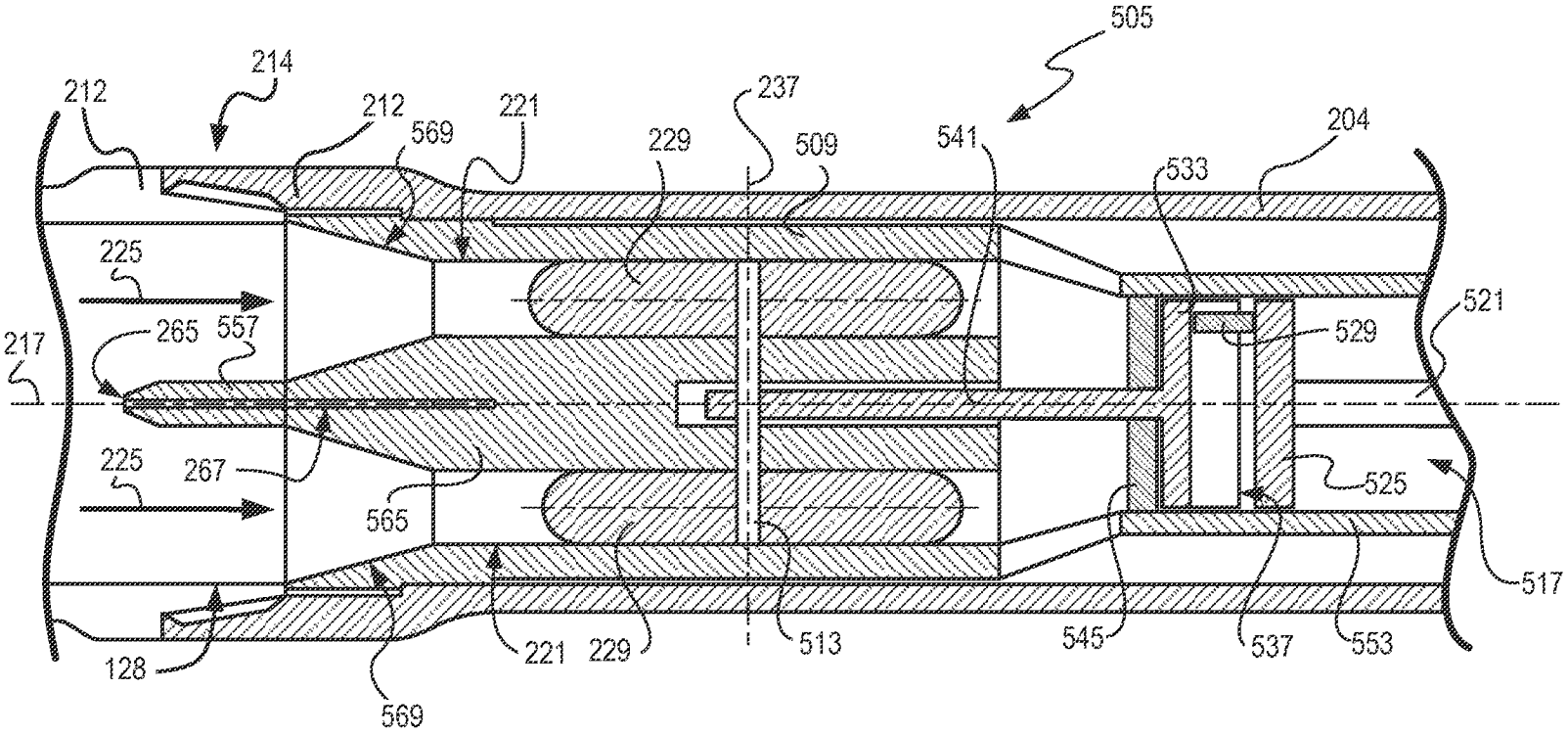
FIG. 6 depicts an enlarged axial section of the drill string portion of FIG. 5, according to the further embodiment.

FIGS. 5 and 6 show a telemetry tool 505 in accordance with another example embodiment. The telemetry tool 505 comprises a housing provided by the tubular drill-pipe housing 204 and a sleeve body 509 mounted co-axially in the housing 204. The sleeve body 509 defines two parallel, laterally spaced signal generator passages 221, with a transmitter bar 229 pivotally mounted in each of the passages 221. These twin passages 221, with their corresponding transmitter bars 229, function substantially similarly to those described above with reference to FIGS. 2-3. The transmitter bars 229 are mounted on a common pivot pin or spindle 513 that extends transversely to the fluid flow direction 225, so that the pivot axis 237 is common to both the transmitter bars 229.

The sleeve body 509 additionally provides a motor housing 553 for a drive mechanism 517 immediately downhole of the passages 221. The drive mechanism 517 comprises a motor 247 drivingly coupled to the spindle 513 by a linkage mechanism that translates rotary motion of a driveshaft 521 of the motor 247 to reciprocating rotary motion of the spindle 513 (which is disposed perpendicularly to the driveshaft 521). In this example embodiment, the linkage mechanism comprises a drive wheel 525 rotationally keyed to the driveshaft 521, with a transmission pin projecting axially from an uphole axial end face of the drive wheel 525, facing the twin signal generator passages 221. The transmission pin 529 is slidingly received in a laterally extending socket slot 537 provided by a rocker block 533 rigidly mounted on a connecting rod 541. The connecting rod 541 extends from the rocker block 533 to the transmitter bar spindle 513, to which it is connected for imparting torque thereto. The rocker block 533 is held captive by a slotted plate 545 located immediately uphole of the rocker block 533. The slotted plate 545 has a guidance slot that extends in a direction parallel to the depth dimension of the signal generator passages 221, being shaped and dimensioned to restrain lateral movement of the connecting rod 541, and therefore of the rocker block 533. In this context, "lateral" means a direction substantially parallel to the pivot axis 237, thus being transverse to both the fluid flow direction 225 and the depth dimension of the signal generator passages 221. The connecting rod 541 and the rocker block 533 are configured to maintain lateral orientation of the socket slot 537.

In operation, driven rotation of the driveshaft 521 causes driven movement of the transmission pin 529 (via the drive wheel 525) along a circular path on a fixed radius relative to the longitudinal axis 217 of the drill string and of the co-axial driveshaft 521. The rocker block 533, however, tracks only a height component (i.e., parallel to the depth dimension of the passages 221) of the transmission pin's (529) circular motion, so that the rocker block 533 reciprocates up and down along a substantially rectilinear path in response to rotation of the drive wheel 525. This reciprocating motion of the rocker block 533 is translated to pivotal reciprocation of the spindle 513, resulting in synchronized rocking of the transmitter bars 229 about the pivot axis 237, to generate fluid pulse telemetry signals by varying occlusion of the respective passages 221.

In the example embodiment of FIG. 5, the flow of borehole fluid downhole of the signal generator passages 221 is directed laterally around the generally tubular motor housing 553 provided by a trailing portion of the sleeve body 509, which has a reduced outer diameter relative to an inner diameter of the tubular housing 204. A part-annular space is defined between the outer diameter of the motor housing 553 and the inner diameter of the tubular housing 204, along which the flow of borehole fluid is channeled.

The example telemetry tool 505 of FIG. 5 also includes a bypass arrangement in the form of a relief passage 261 analogous to that described above with reference to the example embodiment of FIGS. 2-3. The relief passage 221 of the telemetry tool 505, however, has its inlet port 265 substantially centrally in the fluid conduit 128, being located on a nozzle 557 that projects co-axially from a leading end of the sleeve body 509. The outlet port 267 of the relief passage 261 is, in this example embodiment, located at a downhole end of the motor housing 553 of the sleeve body 509, running along a the longitudinally extending rib 561 that projects radially from the tubular motor housing 553. The rib 561 projects into the annular space between the sleeve body 509 and the housing 204, bearing against a cylindrical inner surface of the tubular housing 204. As can be seen in FIG. 5, the rib 561 is one of a pair of diametrically opposed ribs 561 that bear against the housing at diametrically opposed positions of its inner diameter, to center the motor housing 553 in the drill-pipe housing 204, while allowing fluid flow emerging from the signal generator passages 221 to flow laterally around the tubular motor tubular housing 204.

The nozzle 557 is mounted at a leading end of the sleeve body 509 on a leading edge of a longitudinally extending septum-like web 565 that separates the side-by-side signal generator passages 221. The leading edge of the web 565 forms part of twin funnel formations 569 at the leading end of the sleeve body 509, each funnel formation 569 being shaped to channel fluid flow into a corresponding one of the twin signal generator passages 221.

As mentioned previously, the twin transmitter bars 229 are pivotally keyed to the common spindle, and are therefore configured for synchronous oscillation in a manner analogous to that described with reference to FIGS. 2-3.

In operation, controlled synchronized oscillation of the pair of transmitter bars 229 in their respective signal generator passages 221 results in generation of separate fluid pulses emanating uphole from the respective signal generator passages 221. Because of the synchronous oscillatory movement of the transmitter bars 229, the separate pulse signals are at the same frequency and are in phase, so that interference between the signals may comprise superposition of the pulse signals, effectively producing a single pulse signal of an augmented amplitude relative to the amplitude of a single-passage signal pulse.

Note that an amplitude of transmitter bar pivoting 229 (either in the single-bar embodiment of FIGS. 2-4 or in the multi-bar embodiment of FIG. 5) for pulse production need not be equal to the maximum possible pivot position permitted by the geometry of the fluid passage 221 and the bar 229. Partial pivoting of the transmitter bar 229 may, for example, be provided in some instances to produce data pulses of lesser amplitude. The drive mechanism may be customizable to allow selective variation of the oscillation amplitude of the transmitter bar 229. In one example embodiment, the connecting rod 541 is selectively variable in length, allowing operator-controlled variation of axial spacing between the drive motor and the transmitter pin axis 237. When such displacement is allowed, the effective result is to change the pivot angle and therefore change of pulse amplitude. In one embodiment, the connecting rod 541 can be segmented to permit telescopic length variation in response to variation in axial displacement between the drive motor and the transmitter pin axis 237.

When differential amplitude pulse encoding is employed with synchronous excited oscillation of the pair of transmitter, the enabling of three or more pulse amplitudes is enabled. In some embodiments, the pair of pulse generators provided by the pair of transmitter bars 229 in their respective passages 229 may be configured to generate pulses of different amplitude. In such cases, at least three different pulse amplitudes may be generated by controlled bi-directional pivoting of, respectively, (a) one of the transmitter bars 229, (b) the other one of the transmitter bars 229, and (c) both transmitter bars 229 in synchronization.

In other embodiments, a tool with multiple transmitter units (each comprising a transmitter bar 229 mounted in an associated signal generator passage 221) may be configured such that the multiple transmitter bars 229 are not synchronized, so that distinct and/or out of phase pulse signals may be generated by the respective transmitter units. An example embodiment of a tool with such independently movable transmitter elements is described below with reference to FIGS. 7-9. Such separately generated pulse signals may be employed in signal encoding according to one or more of the earlier-described modulations schemes. In other embodiments, or in other applications of embodiments with multiple transmitter units, multiple independent transmitter units can also used to adjust or throttle fluid velocity with one transmitter, and oscillate to produce signals with the other transmitter. This scheme will provide consistent amplitude performance over wide flow ranges.

It is a benefit of the example telemetry tool 505 that it achieves the above-described benefits of the example embodiment of FIG. 3, while presenting a lesser obstruction to fluid flow when the telemetry tool 505 is dormant. Further, independent oscillation of separate transmitter bars 229 enables functionalities that are not readily attainable through use of conventional pulse telemetry devices such as, for example, rotary oscillators. One of these functionalities is selective control of one transmitter bar 229, independently, by relatively slow pivoting or adjustment to control pressure drops based on changes to flow rates. In such cases, the tool 505 may include a control arrangement configured to dynamically adjust the angular position of the particular one of the dual transmitter bars 229 that serves as a throttle, thereby to control fluid flow rate through the sleeve body 509 in order to regulate pulse amplitude of fluid pulse signals generated by pivoting of the other transmitter bar 229.

Figure 7:
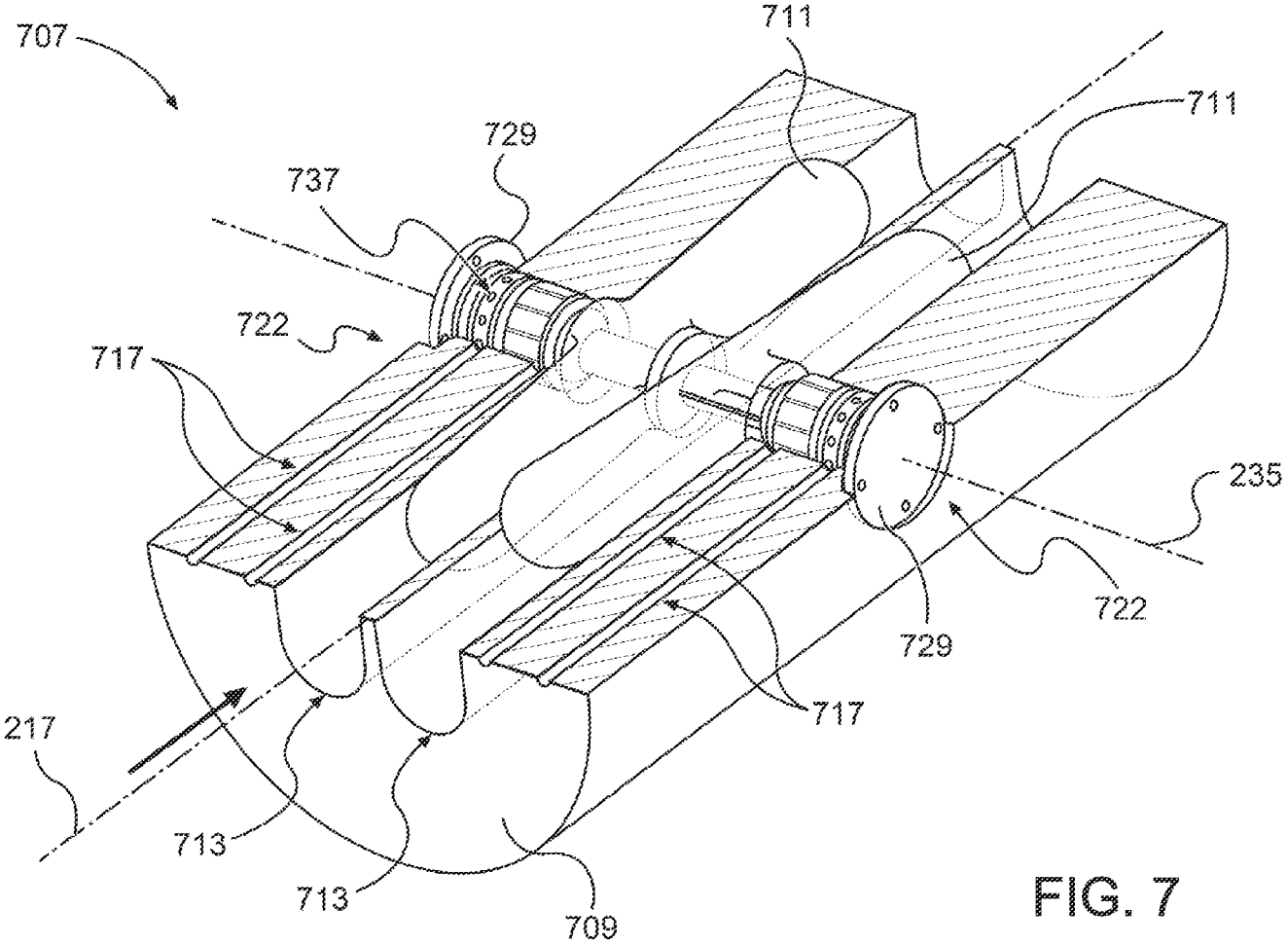
FIG. 7 depicts a partially sectioned three-dimensional view of a hydraulically driven fluid pulse transmitter unit having a pair of independent obstruction members mounted in respective passages, according to another example embodiment.
Figure 8:
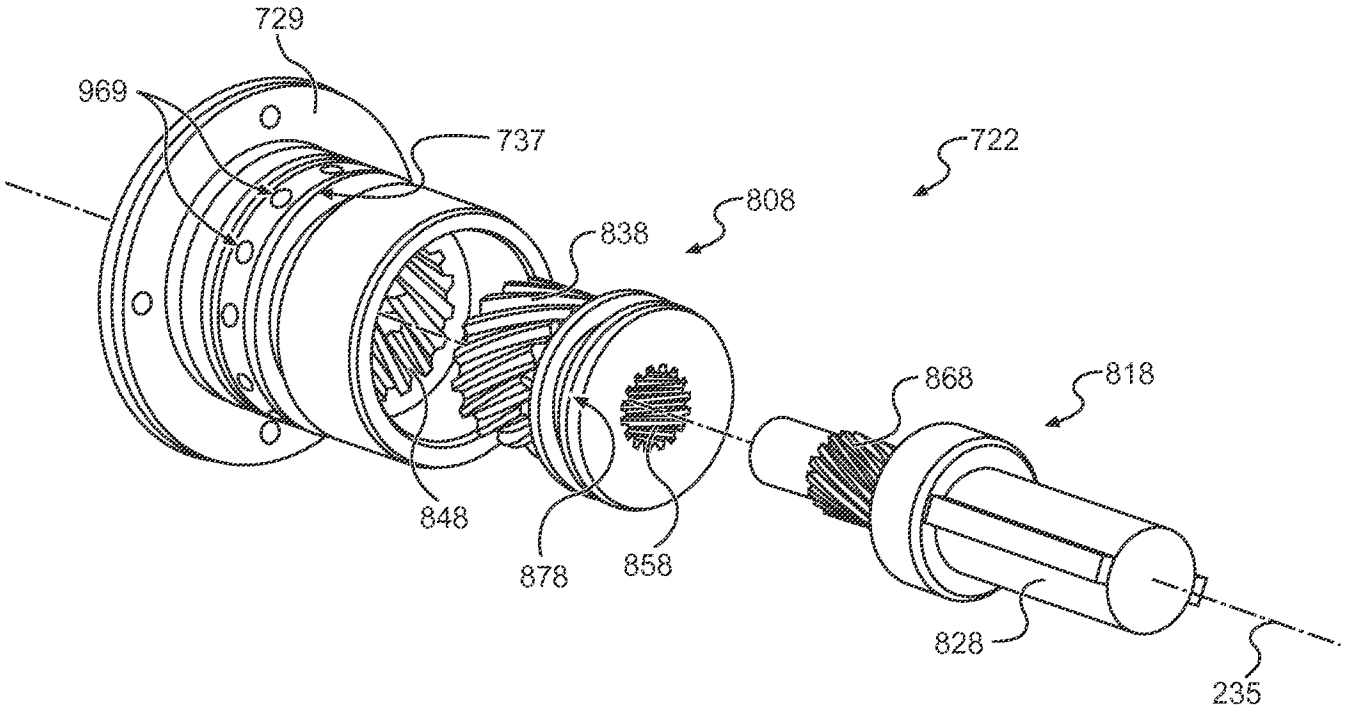
FIG. 8 depicts an exploded three-dimensional view, on an enlarged scale, of an actuator assembly that may form part of the signal generator unit of FIG. 7, according to one example embodiment.
Figure 9:
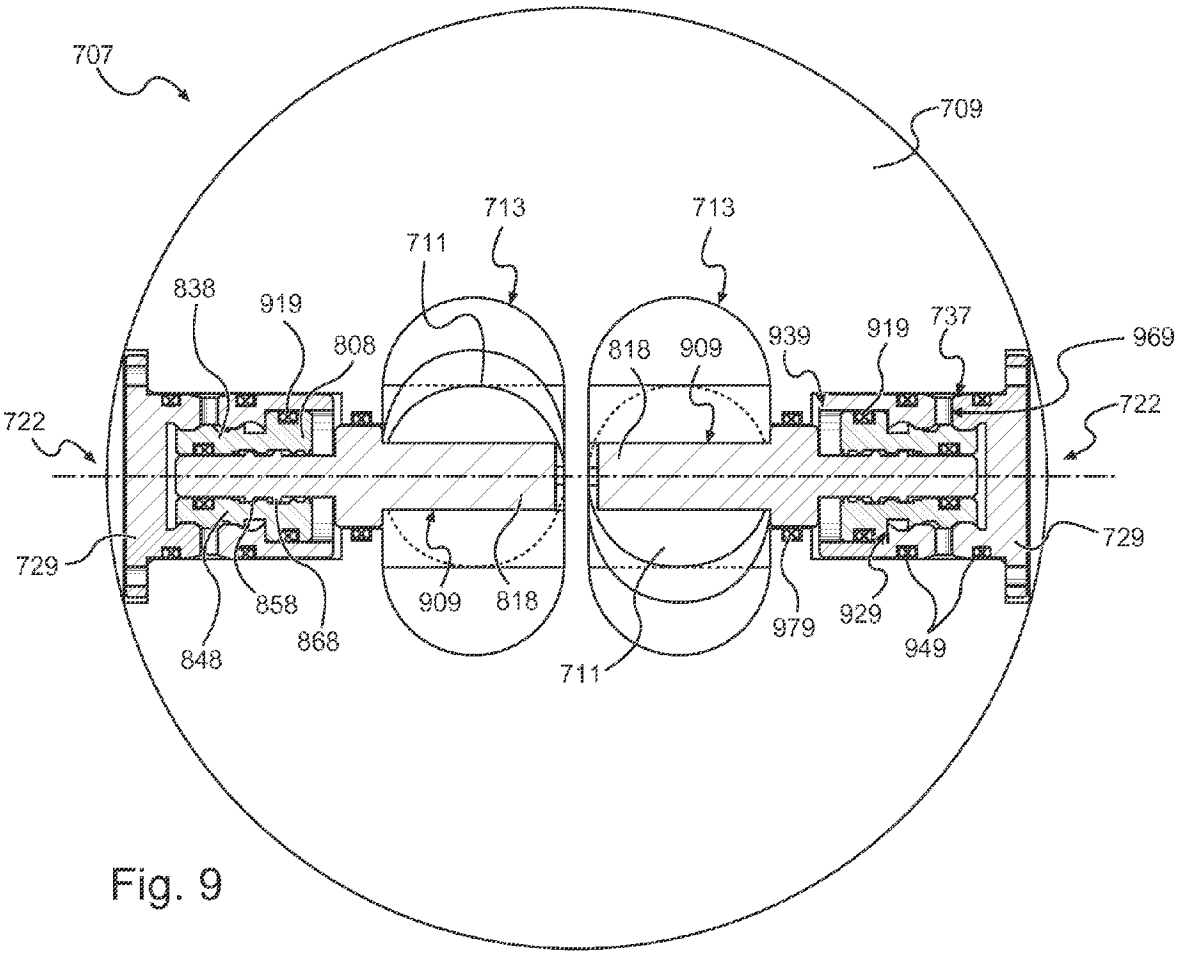
FIG. 9 depicts a schematic cross-section of the signal generator unit of FIG. 7, according to an example embodiment.

FIGS. 7-9 show a fluid pulse transmitter assembly 707 for a drill string telemetry tool according to another example embodiment, the assembly 707 having twin transmitter pins 711 that are configured for independent oscillation. The transmitter pins 711 are analogous to the transmitter bars 229 described with reference to earlier embodiments, and are located in respective complementary passages 713 through a sleeve body 709 for causing controlled variation of drilling mud pressure, as described above. In the example embodiment of FIGS. 7-9, however, independent pivotal oscillation of the transmitter pins 711 is hydraulically controlled and actuated. The telemetry assembly 707 thus has a hydraulic actuating arrangement which includes hydraulic control lines 717 provided by passages extending axially in the sleeve body 709. A pair of hydraulic control lines 717 are provided for each transmitter pin 711 individually. Each hydraulic control lines 717 is filled with hydraulic control fluid (e.g., hydraulic oil), and is in fluid communication with a hydraulic pressure control arrangement. The hydraulic pressure control arrangement may comprise, for example, a high rate solenoid valve(s) in conjunction with hydraulic power generated from traditional flow gear pump arrangements.

As will be understood from the description that follows, angular displacement of each transmitter pin 711 can be controlled separately by controlled variation of a pressure difference between the corresponding pair of hydraulic control lines 717. The direction in which a particular transmitter pin 711 is actuated can likewise be controlled by controlling the orientation of the pressure difference between the corresponding pair of hydraulic control lines 717. When, for example, a laterally inner one of the hydraulic control lines 717 of a particular transmitter pin 711 is at a higher fluid pressure, the transmitter pin 711 may be hydraulically actuated to pivot in one angular direction. Oppositely, the transmitter pin 711 is hydraulically actuated to pivot in the opposite angular direction when a laterally outer one of the hydraulic control lines 717 is at a higher fluid pressure. The assembly 707 comprises a pair of hydraulic actuator assemblies 722 coupled to the respective transmitter pins 711 and configured to drive pivotal oscillation of the transmitter pins 711 by hydraulic action.

Referring now also to FIGS. 8 and 9, it will be seen that each actuator assembly 722 comprises an actuator housing 729 in which a helical piston 808 is sealingly and reciprocably positioned. Each actuator housing 729 is generally tubular and extends co-axially with the pivot axis 237 of the transmitter pins 711, thus being transverse to (in this example embodiment being perpendicular to) the longitudinal axis 217 of the assembly 707. In the context of the embodiment of FIGS. 7-9, "lateral" means a direction transverse to the longitudinal axis 217. Movement along the pivot axis 237 can thus be described as being axial relative to the pivot axis 237, while constituting lateral movement in a larger context, relative to the tool's longitudinal axis 217. Laterally inward orientation or movement means orientation or movement laterally towards to the longitudinal axis 217. Conversely, laterally outward orientation or movement means orientation or movement laterally away from the longitudinal axis 217.

The actuator housings 729 are oppositely oriented, thus facing laterally inwards towards each other. Each helical piston 808 is co-axially received in the corresponding actuator housing 729 and is configured for reciprocating, telescopic movement in the actuator housing 729 along the pivot axis 237. The actuator housings 729 are mounted fixedly on the sleeve body 709, being pivotally and translationally anchored to the sleeve body 709.

A respective spindle shaft 818 is co-axially received in each helical piston 808, with the helical piston 808 being telescopically slidable relative to the spindle shaft 818 along the pivot axis 237. Each transmitter pin 711 is mounted on a corresponding one of the spindle shafts 818. Each transmitter pin 711 is seated on a laterally inner end of the corresponding spindle shaft 818 and is keyed to the spindle shaft 818 for turning with it. Angular displacement of the spindle shaft 818 thus results in corresponding pivoting of the transmitter pin 711. In this embodiment, keying of the transmitter pin 711 to the spindle shaft 818 is by reception of a key formation 828 on the spindle shaft 818 in a complementary slot defined on a radially inner surface of a complementary socket 909 (FIG. 9) in the transmitter pin 711. Each transmitter pin 711 thus turns with the corresponding spindle shaft 818, so that the spindle shaft 818 effectively defines the pivot axis 237.

The helical piston 808 has an external helical profile at its laterally outer end. In this example, the external helical profile is provided by external helical splines 838 (FIG. 8) on a cylindrical outer surface of the piston 808's generally tubular body at its laterally outer end. The actuator housing 729 has an internal helical profile for complementary mating cooperation with the piston 808's external helical profile. In this embodiment, the internal helical profile comprises internal helical grooves 848 for receiving the complementary external helical splines 838 of the helical piston 808. Cooperation of these meshing helical profiles causes angular displacement of the helical piston 808 about the pivot axis 237 in response to hydraulically actuated lateral movement of the piston 808 along the pivot axis 237.

The helical piston 808 further has an internal helical profile, provided in this example by internal helical grooves 858, at its laterally inner end. The spindle shaft 818 has a complementary external helical formation, provided this example by external helical splines 868, at its laterally inner end. The external helical splines 868 of the spindle shaft 818 are received in the complementary helical grooves 858 of the helical piston 808. Cooperation of these meshing helical profiles causes angular displacement of the spindle shaft 818 about the pivot axis 237, relative to the helical piston 808, in response to hydraulically actuated movement of the piston 808 along the pivot axis 237.

As can be seen from the exploded three-dimensional view of one of the actuator assemblies 722 in FIG. 8, the actuator housing 729, the helical piston 808, and the spindle shaft 818 are co-axially connected end-to-end in series with respective interacting helical formations at each interface. Each pair of cooperating helical formations acts to translate relative axial movement to relative angular movement about their common axis (here provided by the pivot axis 237), and vice versa. In the following description, angular movement refers at least partial rotation of the relevant component about the pivot axis 237. Because both the actuator housing 729 and the spindle shaft 818 are anchored against translation along the pivot axis 237, and because only the actuator housing 729 is anchored against angular movement relative to the sleeve body 709, axial movement of the helical piston 808 along the pivot axis 237 translates to angular displacement of the spindle shaft 818, and therefore to pivoting of the transmitter pin 711 mounted on it. It will be understood that different directions of axial movement for the helical piston 808 results in movement of the transmitter pin 711 in opposite directions.

In this example embodiment, the helical interfaces between (a) the actuator housing 729 and the helical piston 808, and (b) the helical piston 808 and the spindle shaft 818 are configured such that hydraulically actuated axial translation of the helical piston 808 in a particular direction along the pivot axis 237 results in angular displacement of (a) the helical piston 808 relative to the actuator housing 729, and (b) the spindle shaft 818 relative to the helical piston 808 in the same direction. Angular displacement of the spindle shaft 818 due to axial movement of the helical piston 808 is thus amplified in that the spindle shaft 818 receives both the angular displacement of the helical piston 808 relative to the actuator housing 729, as well as receiving (super-imposed on the angular displacement of the piston 808) its own angular displacement relative to the helical piston 808 due to operation of the complementary splines 868 and grooves 858. Relatively small axial displacements for the helical piston 808 can thus translate to pivotal movement of the transmitter pins 711 through the full amplitude of oscillatory movement. Differently described, the spindle shaft 818 will be turned at a greater speed (angular velocity) than the helical piston 808, since the engagement between the helical profiles of the splines 868 and grooves 858 turn both in response to axial displacement of the helical piston 808, and in response to turning of the helical piston 808. Thus, the actuator assembly 722 can produce relatively fast pivoting of the transmitter pin 711 in response to relatively small linear displacements of the piston 808. Small displacements of the piston 808 can be conveniently produced with relatively low power requirements for hydraulic components of the hydraulic actuating mechanism, such as the pump for pressurizing oil in the control lines 717.

Note that although the helical interfaces of the telescopically connected components for the actuator assembly 722 are described in the above example embodiment as being provided by spline-and-groove formations, other types of helical profiles may be used in other embodiments, for example comprising threads or ramps. Likewise, internal helical profiles and complementary external helical profiles may be provided differently on the respective components without materially altering the mechanism of operation of the actuator assembly 722 as described.

Selected aspects of the hydraulic mechanism for actuating axial movement of the helical piston 808 will now be briefly described. As shown in FIGS. 8 and 9, the helical piston 808 has a pair of annular flanges that define between them an O-ring seat 878 (FIG. 8). When the helical piston 808 is received in the actuator housing 729, an O-ring 919 (FIG. 9) seated between the flanges sealingly engages a cylindrical wall defined by the interior of the actuator housing 729. Referring now to FIG. 9, it will be seen that the interior of the actuator housing 729 defines a pair of pressure chambers separated by the O-ring 919. A laterally a laterally outer chamber 929 is located laterally outside of the O-ring 919 (i.e., further away from the transmitter pin 711 along the pivot axis 237); and a laterally inner chamber 939 is located laterally inside of the O-ring 919 (i.e., closer to the transmitter pin 711 along the pivot axis 237). Pressure differentials between the inner chamber 939 and the outer chamber 929 thus cause hydraulically actuated movement of the helical piston 808 within the actuator housing 729.

As can best be seen in FIG. 8, the actuator housing 729 has a circumferentially extending channel 737 in its radially outer surface. The laterally outer hydraulic line 717 opens out into the circumferential channel 737 (FIG. 7). Sealing members in the form of O-rings 949 seated on the outer cylindrical surface of the actuator housing 729 sealingly engage the cylindrical wall of a complementary socket for the housing 729 in the sleeve body 709. A circumferentially extending series of supply passages 969 extend radially (relative to the pivot axis 237) through a tubular wall of the actuator housing 729, to place the circumferential channel 737 in fluid communication with the outer chamber 929.

Similarly, the laterally inner hydraulic line 717 is in fluid communication with the inner chamber 939 via an open end of the tubular actuator housing 729 at its laterally inner end. The inner chamber 939 is thus partially defined by the sleeve body 709, being sealed at its laterally inner end by a sealing element in the form of an O-ring 979 on the spindle shaft 818 and seated in a complementary slot defined by the sleeve body 709.

In operation, the respective transmitter pins 711 can be controlled independently by controlling fluid pressure differences between the inner chamber 939 and the outer chamber 929 via the respective control lines 717. To actuate oscillating pivotal movement of the associated transmitter pin 711, the pressure difference is thus oscillated to cause oscillating lateral translation movement of the helical piston 808 along the pivot axis 237.

As mentioned earlier, one of the transmitter pins 711 may be configured to act as a regulator throttle to achieve a relatively constant signal pulse amplitude. The throttle pin 711 may in such cases be dynamically controlled by a control arrangement coupled to the hydraulic control lines 717. Such a control arrangement may include an electronic or hydraulic feedback loop to dynamically adjust the angular position of the throttle pin 711 responsive to fluid pressure upstream of the sleeve body 709. In another embodiment, or in another application of the example embodiment of FIGS. 7-9, the dual transmitter pins 711 may be configured for synchronized rhythmic oscillation at different amplitudes.

It can be seen that above-described example embodiments realize various aspects of the disclosed subject matter. One aspect comprises a an apparatus for producing fluid pulse telemetry signals, the apparatus comprising:

a body having a fluid passage therethrough, the body configured for incorporation in a drill string to permit flow of borehole fluid through the fluid passage in a fluid flow direction; and an elongate obstruction member pivotably mounted in the fluid passage about a pivot axis transverse to the fluid flow direction, such that an extent of obstruction of the fluid passage by the obstruction member varies in relation to pivotal position of the obstruction member.

The apparatus may be a tool assembly as described in the above example embodiments. In other embodiments, the apparatus may be a drill tool that includes a tubular housing configured for incorporation in a drill string by in-line connection with neighboring drill pipe sections. Yet further, the apparatus may be a drill string or a drilling installation that includes a fluid passage and a corresponding pivotal obstruction member, as described.

The pivot axis may intersect the fluid passage, and may in some embodiments bisect the fluid passage. The pivot axis may be transverse to both the fluid flow direction and the obstruction member, for example being orthogonal to both an axis of the fluid passage and a lengthwise axis of the obstruction member.

At least a portion of the fluid passage may have a noncircular cross-section along which an end of the obstruction member moves when pivoting. The noncircular cross-section may be oblong, the fluid passage having a depth dimension greater than a transverse width dimension orthogonal thereto, with the pivot axis of the obstruction member being substantially parallel to the width dimension of the fluid passage.

The obstruction member may substantially span the fluid passage widthwise, so that fluid flow around the sides of the obstruction member is prevented, thus allowing fluid flow substantially exclusively through a pair of end gaps defined between the passage wall and opposite lengthwise end portions of the obstruction member. It will be appreciated in this regard that each of the gaps at the opposite ends of the obstruction member is defined between the obstruction member and different respective portions of a passage wall provided by the body.

A length dimension of the obstruction member may be greater than the depth dimension of the fluid passage, the obstruction member being pivotable to a maximally obstructive position in which at least one of a pair of lengthwise end portions of the obstruction member bears against the body. In some embodiments, the pivot axis may be located substantially centrally along the depth dimension of the fluid passage, and the obstruction member may be substantially centered lengthwise on the pivot axis, which may be one instance of a configuration in which the apparatus is configured such that both opposite end portions of the obstruction member bear against the passage wall in the maximally obstructive position.

In other embodiments, the obstruction member and the fluid passage may be configured such that only one of the pair of opposite lengthwise end portions engages the passage wall when the obstruction member is disposed in the maximally obstructive position, so that a bypass clearance is defined between the passage wall and the other one of the pair of lengthwise end portions. In one example embodiment, such a configuration may be achieved by off-center location of the pivot axis relative to the length of the obstruction member.

The obstruction member may be pivotally displaceable in opposite directions for disposal in two oppositely oriented maximally obstructive positions, with an operatively upstream one of the pair of lengthwise end portions being spaced from the passage wall in both maximally obstructive positions, to define respective bypass clearances for the two maximally obstructive positions.

The apparatus may further comprise a bias arrangement configured to exert a biasing torque on the obstruction member, to urge the obstruction member to a minimally obstructive position. The minimally obstructive position may correspond to the orientation of the obstruction member such that it is lengthwise aligned with the fluid flow direction. In some embodiments, the bias arrangement may be configured to cause biasing of the obstruction member to the minimally obstructive position through hydrodynamic action of borehole fluid on the obstruction member in response to the flow of borehole fluid through the fluid passage. One example of such a biasing arrangement comprises location of the pivot axis off-center on the obstruction member such that the pivot axis is closer to a leading end of the obstruction member than to a trailing end thereof.

The apparatus may further comprise a drive mechanism operatively coupled to the obstruction member and configured to drive bidirectional movement of the obstruction member about the pivot axis, to produce the fluid pulse telemetry signals by causing controlled fluid pressure variations in the borehole fluid. The drive mechanism may be configured for controlling variation of a pivot angle through which the obstruction member is displaceable about the pivot axis during driven bidirectional movement, thereby to control variation in pulse amplitude of the fluid pulse telemetry signals. Instances, for example, where the drive mechanism comprises a motor coupled to the obstruction member, the drive mechanism may comprise an adjustable linkage which is variable in length to achieve variation in oscillation amplitude.

The drive mechanism may be configured to drive pivotal displacement of the obstruction member by hydraulic actuation, the drive mechanism comprising a piston mounted on the body for hydraulically actuated bidirectional movement co-axial with the pivot axis, the piston being operatively coupled to the obstruction member such that driven bidirectional translation of the piston causes bidirectional pivoting of the obstruction member. The apparatus may in such cases further comprising a spindle co-axial with the pivot axis and pivotally keyed to the obstruction member, the spindle being telescopically coupled with the piston via complementary mating helical profiles on the piston and the spindle respectively, the helical profiles being configured to transfer torque and angular displacement received by the piston to the spindle, and to translate axial movement of the piston along the pivot axis to angular displacement of the spindle. The apparatus may also comprise a piston housing that is keyed against angular movement relative to the body, the piston being telescopically coupled to the piston housing via complementary mating helical formations on the piston and the housing respectively, the helical formations being configured to cause relative angular displacement of the piston in response to hydraulically actuated relative translation of the piston along the pivot axis.

In some embodiments, the obstruction member is disposable to a maximally obstructive position in which the obstruction member substantially occludes the fluid passage. In such cases, the apparatus may further comprise a bypass arrangement configured to permit, when the obstruction member is in the maximally obstructive position, relief flow from an upstream side of the obstruction member to a downstream side of the obstruction member. The bypass arrangement comprise one or more peripheral grooves in an exterior surface of the obstruction member. Instead, or in addition, the bypass arrangement may comprise an internal bypass channel extending longitudinally through the obstruction member. In some embodiments, the bypass arrangement comprises a pressure relief passage defined by the body, the pressure relief passage having an inlet port from the fluid passage at a position upstream of the obstruction member, and having an outlet port downstream of the obstruction member.

The apparatus may define a plurality of fluid passages, provided with a plurality of obstruction members, each obstruction member being mounted in a corresponding one of the plurality of fluid passages. In such cases, the drive mechanism may be configured to drive independent pivotal movement of the respective obstruction members. Instead, the drive mechanism may be configured to drive the plurality of obstruction members in common. In one embodiment, the plurality of obstruction members comprises a pair of obstruction members that are mounted for pivoting about a common pivot axis, the pair of obstruction members being located in respective fluid passages which are laterally spaced relative to the fluid flow direction.

Another aspect of the disclosure relates to a method for producing fluid pulse telemetry signals in a drill string, the method comprising:

incorporating in the drill string a signal generator comprising an elongate obstruction member mounted in a fluid passage located in the drill string to convey borehole fluid in a fluid flow direction, the obstruction member being pivotable about a pivot axis transverse to the fluid flow direction; and generating data pulses in the borehole fluid by driven bidirectional pivoting of the obstruction member, to vary an extent of obstruction of the fluid passage by the obstruction member.

In embodiments where the signal generator comprises a plurality of obstruction members pivotally mounted in respective fluid passages, the generating of the data pulses may comprise causing synchronous pivotal movement of the plurality of obstruction members. Note that the synchronous pivotal movement means movement at the same time, but does not necessarily mean that the movement is identical or synchronized, although that may be the case in some instances.

The synchronous pivotal movement may comprise independently driven pivotal oscillation of the plurality of obstruction members at different respective amplitudes and/or frequencies. Instead, causing the synchronous movement to generate the data pulses may comprise (a) pivotally oscillating a particular one of the plurality of obstruction members to produce fluid pressure variations, and (b) controlling fluid velocity at the fluid passage by adjusting pivotal orientation of another one of the obstruction members, thereby to control amplitudes of the fluid pressure variations produced by the particular obstruction member. In some embodiments, the fluid velocity (and hence pulse amplitudes) may be controlled dynamically, so that the pivotal position of the obstruction member and that serves as a control throttle may be adjusted dynamically, based in part on a feedback loop that measures fluid pressure in the drill string.

Yet a further aspect of the disclosure relates to a drill string comprising:

drill pipe configured to extend lengthwise within a borehole and defining a fluid conduit to convey borehole fluid, the fluid conduit including a fluid passage to convey borehole fluid in a fluid flow direction;

an elongate obstruction member pivotably mounted in the fluid passage about a pivot axis transverse to the fluid flow direction; and a drive mechanism coupled to the obstruction member and configured for driving bidirectional pivoting of the obstruction member, to vary an extent of obstruction of the fluid passage by the obstruction member and thereby to produce data-carrying fluid pressure variations in the borehole fluid.

In the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, subject matter which protection is sought lies in less than all features of a single disclosed embodiment. Thus the following claims are hereby incorporated into the Detailed Description, with each claim standing on its own as a separate embodiment.

What is claimed is:

1. An apparatus for producing fluid pulse telemetry signals, the apparatus comprising:

a body having a fluid passage therethrough, the body configured for incorporation in a drill string to permit flow of borehole fluid through the fluid passage in a fluid flow direction; and an elongate obstruction member pivotably mounted in the fluid passage about a pivot axis transverse to the fluid flow direction, such that an extent of obstruction of the fluid passage by the obstruction member varies in relation to pivotal position of the obstruction member.

2. The apparatus of claim 1, wherein at least a portion of the fluid passage has a noncircular cross-section along which an end of the obstruction member moves when pivoting.

3. The apparatus of claim 2, wherein the noncircular cross-section is oblong, the fluid passage having a depth dimension greater than a transverse width dimension orthogonal thereto, the pivot axis of the obstruction member being substantially parallel to the width dimension of the fluid passage.

4. The apparatus of claim 3, wherein the obstruction member substantially spans the fluid passage widthwise, allowing fluid flow substantially exclusively through a pair of end gaps defined between the body and opposite lengthwise end portions of the obstruction member.

5. The apparatus of claim 3, wherein a length dimension of the obstruction member is greater than the depth dimension of the fluid passage, the obstruction member being pivotable to a maximally obstructive position in which at least one of a pair of lengthwise end portions of the obstruction member bears against the body.

6. The apparatus of claim 5, wherein the obstruction member and the fluid passage are configured such that only one of the pair of opposite lengthwise end portions engages the body when the obstruction member is disposed in the maximally obstructive position, a bypass clearance being defined between the body and the other one of the pair of lengthwise end portions.

7. The apparatus of claim 1, further comprising a bias arrangement configured to exert a biasing torque on the obstruction member, to urge the obstruction member to a minimally obstructive position.

8. The apparatus of claim 7, wherein the bias arrangement is configured to cause biasing of the obstruction member to the minimally obstructive position through hydrodynamic action of borehole fluid on the obstruction member in response to the flow of borehole fluid through the fluid passage.

9. The apparatus of claim 1, further comprising a drive mechanism operatively coupled to the obstruction member and configured to drive bidirectional movement of the obstruction member about the pivot axis, to produce the fluid pulse telemetry signals.

10. The apparatus of claim 9, wherein the drive mechanism is configured for controlling variation of a pivot angle through which the obstruction member is displaceable about the pivot axis during driven bidirectional movement, thereby to control variation in pulse amplitude of the fluid pulse telemetry signals.

11. The apparatus of claim 1, in which the obstruction member is disposable to a maximally obstructive position in which the obstruction member substantially occludes the fluid passage, the apparatus further comprising a bypass arrangement configured to permit, when the obstruction member is in the maximally obstructive position, relief flow from an upstream side of the obstruction member to a downstream side of the obstruction member.

12. The apparatus of claim 11, wherein the bypass arrangement comprises one or more peripheral grooves in an exterior surface of the obstruction member.

13. The apparatus of claim 11, wherein the bypass arrangement comprises an internal bypass channel extending longitudinally through the obstruction member.

14. The apparatus of claim 1, wherein the body has a plurality of fluid passages and a plurality of obstruction members, each obstruction member being mounted in a corresponding one of the plurality of fluid passages.

15. The apparatus of claim 14, wherein the plurality of obstruction members comprises a pair of obstruction members that are mounted for co-axial pivoting, the pair of obstruction members being located in respective fluid passages which are laterally spaced relative to the fluid flow direction.

16. A method for producing fluid pulse telemetry signals in a drill string, the method comprising:

incorporating in the drill string a signal generator comprising an elongate obstruction member mounted in a fluid passage located in the drill string to convey borehole fluid in a fluid flow direction, the obstruction member being pivotable about a pivot axis transverse to the fluid flow direction; and generating data pulses in the borehole fluid by driven bidirectional pivoting of the obstruction member, to vary an extent of obstruction of the fluid passage by the obstruction member.

17. The method of claim 16, wherein the signal generator comprises a plurality of elongate obstruction members pivotally mounted in respective fluid passages, and wherein the generating of the data pulses comprises causing synchronous pivoting of the plurality of obstruction members.

18. The method of claim 17, wherein the synchronous pivoting comprises independently driven pivotal oscillation of the plurality of obstruction members at different respective amplitudes and/or frequencies.

19. The method of claim 17, wherein the synchronous pivoting to generate the data pulses comprises:

pivotally oscillating a particular one of the plurality of obstruction members to produce the data pulses; and controlling fluid velocity at the fluid passage by adjusting a pivotal position of another one of the obstruction members, thereby to control amplitudes of the data pulses.

20. A drill string comprising:

drill pipe configured to extend lengthwise within a borehole and defining a fluid conduit to convey borehole fluid, the fluid conduit including a fluid passage to convey borehole fluid in a fluid flow direction;

an elongate obstruction member pivotably mounted in the fluid passage about a pivot axis transverse to the fluid flow direction; and a drive mechanism coupled to the obstruction member and configured for driving bidirectional pivoting of the obstruction member, to vary an extent of obstruction of the fluid passage by the obstruction member and thereby to produce data-carrying fluid pressure variations in the borehole fluid.

* * * * *